US006145792A

United States Patent [19]

Penza et al.

[11] Patent Number: 6,145,792

[45] **Date of Patent: *Nov. 14, 2000**

[54] RAILROAD WORKER WARNING SYSTEM FOR TRAIN CONDUCTORS

[76] Inventors: George Gregory Penza, 92 Central Pkwy., Huntington; George Robert Penza, 4 E. Gate La., Old Field, both of N.Y. 11743

[ * ] Notice: This patent issued on a continued prosecution application filed under 37 CFR 1.53(d), and is subject to the twenty year patent term provisions of 35 U.S.C. 154(a)(2).

[21] Appl. No.: 09/069,132

[22] Filed: Apr. 29, 1998

[51] Int. Cl.[7] ..... B61L 3/00

[52] U.S. Cl. ..... 246/167 A; 246/122 R; 246/124

[58] Field of Search ..... 246/122 R, 124, 246/167 A

[56] References Cited

U.S. PATENT DOCUMENTS

| | | |
|---|---|---|
| 2,762,913 | 9/1956 | Jepson . |
| 5,303,259 | 4/1994 | Loveall . |
| 5,415,369 | 5/1995 | Hungate . |
| 5,461,366 | 10/1995 | Figuereo et al. . |
| 5,554,982 | 9/1996 | Shirkey et al. . |
| 5,572,201 | 11/1996 | Graham et al. . |
| 5,620,155 | 4/1997 | Michalek . |
| 5,727,758 | 3/1998 | Penza et al. . |

FOREIGN PATENT DOCUMENTS

| | | |
|---|---|---|
| 24 05 408 | 7/1975 | Germany . |
| 42 19 067 | 6/1992 | Germany . |
| 52-35504 | 3/1977 | Japan . |
| 63-315369 | 12/1988 | Japan . |
| 4-126664 | 4/1992 | Japan . |
| 4-163273 | 6/1992 | Japan . |
| 6-1239 | 1/1994 | Japan . |
| 374214 | 6/1973 | Russian Federation . |
| 94/21504 | 9/1994 | WIPO . |

*Primary Examiner*—S. Joseph Morano
*Assistant Examiner*—Robert J. McCarry, Jr.
*Attorney, Agent, or Firm*—Brooks & Kushman P.C.

[57] ABSTRACT

A warning system and method for warning a train operator that the train is approaching personnel at a railroad station includes a transmitter disposed at the railroad station for transmitting a radio frequency (RF) warning signal with a given power output. A receiver is disposed on the train for receiving the RF warning signal. The receiver generates an alarm to notify the train operator of the presence of the personnel at the railroad station upon receiving the RF warning signal. A transmitter is disposed on the train for transmitting an RF confirmation signal upon receipt of the RF warning signal by the receiver disposed on the train. A receiver disposed at the railroad station receives the RF confirmation signal. The receiver disposed at the railroad station generates an alarm to notify the personnel that the train operator is aware of the presence of the personnel at the railroad station upon receiving the RF confirmation signal.

10 Claims, 2 Drawing Sheets

RAILROAD WORKER WARNING SYSTEM FOR TRAIN CONDUCTORS

TECHNICAL FIELD

The present invention relates generally to railway switches and signals and, more particularly, to a system and method for warning an operator of a train that the train is approaching railroad personnel at a railroad station.

BACKGROUND ART

Train operators operating trains need to be aware of the presence of railroad personnel along the railroad tracks. Similarly, the personnel need to be aware of approaching incoming trains.

U.S. Pat. No. 5,727,758, disclosed by the applicants of the present invention, discloses a warning system and method for warning personnel in proximity to railroad tracks of an approaching train. A problem with the warning system and method disclosed in the U.S. Pat. No. 5,727,758 patent is that while the personnel are aware of the presence of the approaching train, the train operator may be unaware of the presence of the personnel.

SUMMARY OF THE INVENTION

Accordingly, it is an object of the present invention to provide a warning system and method for warning an operator of a train that the train is approaching railroad personnel at a railroad station.

It is another object of the present invention to provide a warning system and method using a portable radio frequency transmitter carried by at least one of the personnel for transmitting a radio frequency (RF) warning signal to the train operator.

It is a further object of the present invention to provide a warning system and method using a transmitter disposed on the train for transmitting an RF confirmation signal to the personnel upon receipt of the RF warning signal.

In carrying out the above objects, the present invention provides a warning system for warning an operator of a train that the train is approaching personnel in proximity to railroad tracks at a railroad station. The system includes a transmitter disposed at the railroad station for transmitting a radio frequency (RF) warning signal with a given power output along a wireless RF transmission path. A receiver is disposed on the train for receiving the RF warning signal along the wireless RF transmission path. The receiver generates an alarm to notify the train operator of the presence of the personnel at the railroad station upon receipt of the RF warning signal.

The system may further include a transmitter disposed on the train for transmitting an RF confirmation signal upon receipt of the RF warning signal by the receiver disposed on the train. A receiver disposed at the railroad station receives the RF confirmation signal. The receiver disposed at the railroad station generates an alarm to notify the personnel that the train operator is aware of the presence of the personnel at the railroad station upon receipt of the RF confirmation signal.

Preferably, the transmitter and receiver disposed at the railroad station are portable devices carried by at least one of the personnel. In accordance with the warning system of the present invention, a warning method is also provided.

The advantages accruing to the present invention are numerous. The present invention is well suited for subway systems which utilize tunnels and elevated track where egress from the track is limited. The present invention enables the train operator such as a motorman, a conductor, and the like to be alerted of the presence of the personnel a predetermined amount of time prior to the arrival of the train at the railroad station to take any corrective action.

These and other features, aspects, and embodiments of the present invention will become better understood with regard to the following description, appended claims, and accompanying drawings.

BEST MODES FOR CARRYING OUT THE INVENTION

Figure 1:
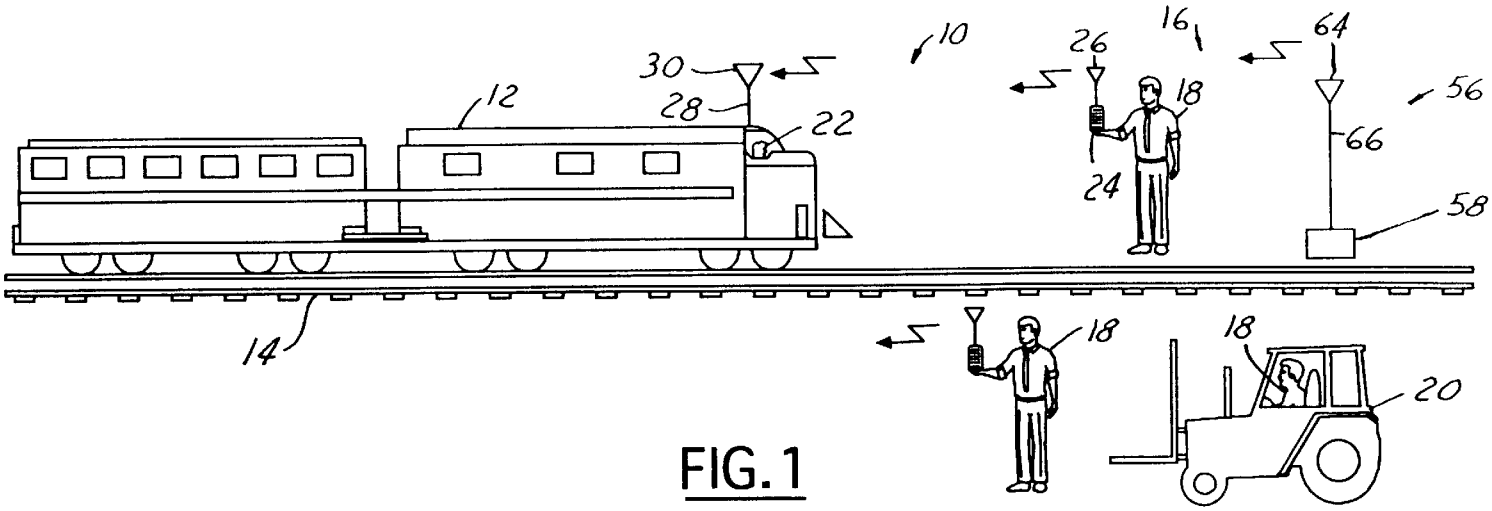
FIG. 1 is a schematic representation of the system of the present invention for warning an operator of a train that the train is approaching railroad personnel.
Figure 2:
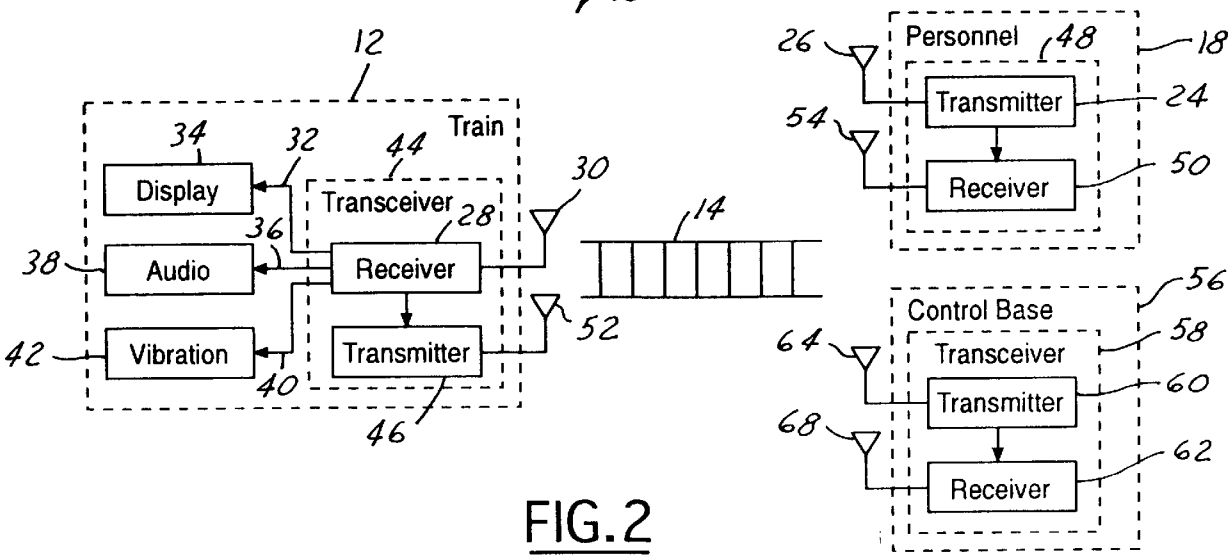
FIG. 2 is a block diagram of the warning system.

Referring now to FIGS. 1 and 2, a railroad worker warning system 10 for train operators is shown. Warning system 10 includes a train 12 riding on railroad or subway tracks 14. Train 12 is traveling on tracks 14 toward a railroad or subway station 16. Station 16 may be located anywhere along tracks 14. Adjacent station 16, railroad personnel 18 carry out their various railroad responsibilities. Personnel 18 may be performing construction with machinery such as back hoes, drills, jack hammers, and the like. Personnel 18 may also be performing heavy construction tasks with heavy machinery such as a crane 20. Personnel 18 may further be performing other tasks such as switching tracks 14 to change the course of train 12 as it passes through station 16.

An operator 22 on train 12 operates the train. Train operator 22 needs to be aware that train 12 is approaching personnel 18. System 10 provides for enhanced communication between train operator 22 and personnel 18 so that the operator is aware that train 12 is approaching the personnel without actually having to see the personnel. To this end, at least one of personnel 18 carries a portable transmitter 24 for transmitting a warning signal to train operator 22 to warn the operator that train 12 is approaching the personnel.

In a preferred embodiment, transmitter 24 includes an antenna 26 and transmits a radio frequency (RF) warning signal from the antenna continuously while personnel 18 are adjacent tracks 14. The RF warning signal preferably has a carrier frequency in the range of 900 MHz to 980 MHz which includes the designated beeper and pager frequencies. Of course, transmitter 24 may be configured to transmit at any available frequency used for electronic communication. Transmitter 24 is preferably a variable output transmitter and transmits the warning signal at a given power output.

Train 12 includes a receiver 28 and an antenna 30 for receiving the RF warning signal from transmitter 24 along a wireless RF transmission path. Receiver 28 is tuned to the carrier frequency of the RF warning signal. Upon receipt and processing of the RF warning signal, receiver 28 actuates an alarm signal. The alarm signal notifies train operator 22 that train 12 is approaching personnel 18.

The alarm signal may take on a variety of forms. For instance, receiver 28 may generate an output signal 32 for actuating a visual display 34. Visual display 34 may include flashing lights, alphanumeric messages, and the like. Receiver 28 may also generate an output signal 36 for actuating an audio alarm 38. Receiver 28 may further generate an output signal 40 for actuating a vibratory alarm 42. Vibratory alarm 42 causes receiver 28 to vibrate to alert train operator 22 to check the receiver. Receiver 28 may be configured to actuate any combination of the alarm signals to notify train operator 22 that train 12 is approaching personnel 18.

Receiver 28 disposed in train 12 is part of a transceiver 44 and is coupled to a transmitter 46 of the transceiver. Similarly, transmitter 24 carried by personnel 18 is part of a transceiver 48 and is coupled to a receiver 50 of the transceiver. Transmitter 46 transmits an RF confirmation signal along a wireless RF transmission path from an antenna 52 to an antenna 54 of receiver 50 upon confirmation that receiver 28 has received the RF warning signal transmitted by transmitter 24. The confirmation signal notifies personnel 18 that train operator 22 has received the RF warning signal and is aware of the presence of the personnel.

In addition to or instead of personnel 18 carrying transmitter 24, warning system 10 may also include a portable control base 56 having a transceiver 58 disposed at railroad station 16. Transceiver 58 includes a transmitter 60 and a receiver 62. Transmitter 60 includes an antenna 64 for transmitting a radio frequency (RF) warning signal from the antenna continuously while personnel 18 are adjacent tracks 14. Antenna 64 is preferably mounted on a tower 66 to avoid obstructions which may interfere with the transmission of the RF warning signal to train 12.

Receiver 62 includes an antenna 68 for receiving the RF confirmation signal from transmitter 46. Upon receipt of the RF confirmation signal, receiver 62 actuates a confirmation alarm signal. The confirmation alarm signal notifies all personnel 18 in the vicinity of control base 56 that the RF confirmation signal from train operator 22 has been received, and that train 12 will shortly be approaching station 16. The confirmation alarm signal may take on a variety of forms such as visual display and audio.

According to the present invention as described, transmitter 24 carried by personnel 18 transmits an RF warning signal to receiver 28 on train 12. Various known techniques in the radio and paging art, such as digital and analog communication, may be employed to make the connection. For instance, transmitter 24 may simply transmit a single carrier frequency. Transmitter 24 may also frequency or amplitude modulate a carrier signal with an information signal. Transmitter 24 may include an encoder for encoding a coded signal into the RF warning signal. In turn, receiver 28 may include a decoder for decoding the RF warning signal to extract the coded signal before actuating an alarm. If the coded signal is not included with the RF warning signal, then receiver 28 is configured to not activate an alarm. Thus, receiver 28 is not susceptible to premature alarm activation due to outside RF interference or illegal RF transmission. The RF warning signal may transmit along frequencies used for voice communications.

Figure 3:
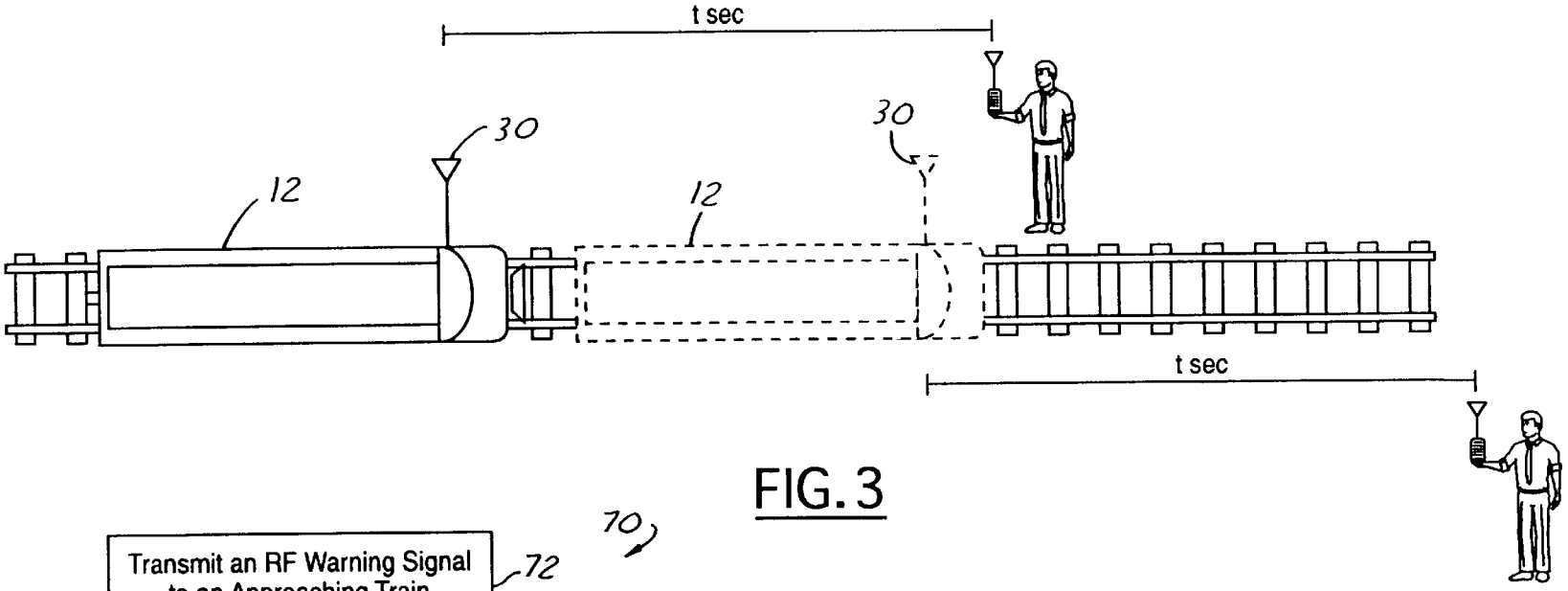
FIG. 3 is an illustration showing the train operator being warned of the presence of the railroad personnel a predetermined amount of time ahead of the arrival of the train at the railroad station.

Referring now to FIGS. 2 and 3, an advantage of the present invention is that warning system 10 may be configured so that train operator 22 is warned at least a predetermined amount of time prior to the moment train 12 reaches personnel 18. For example, the predetermined amount of time may be at least fifteen seconds. As a result, upon receiver 28 receiving the RF warning signal, train 12 will reach station 16 and personnel 18 after fifteen seconds.

To enable train operator 22 to be warned at least a predetermined amount of time prior to train 12 reaching station 16 and personnel 18, transmitter 24 transmits RF warning signal with a selected power output dependent upon the maximum allowable speed of train 12. As known to those skilled in the art, an RF signal having more power is able to reach a farther destination along a wireless RF transmission path than an RF signal having less power. In essence, the range of an RF signal depends on the power output. Thus, transmitter 24 transmits the RF warning signal with a given power output dependent upon the assumption that train 12 is travelling at its maximum allowable speed to warn train operator 22 a predetermined amount of time prior to train 12 reaching personnel 18. Shortly thereafter, personnel 18 are warned that train 12 is approaching upon receipt of the RF confirmation signal.

Figure 4:
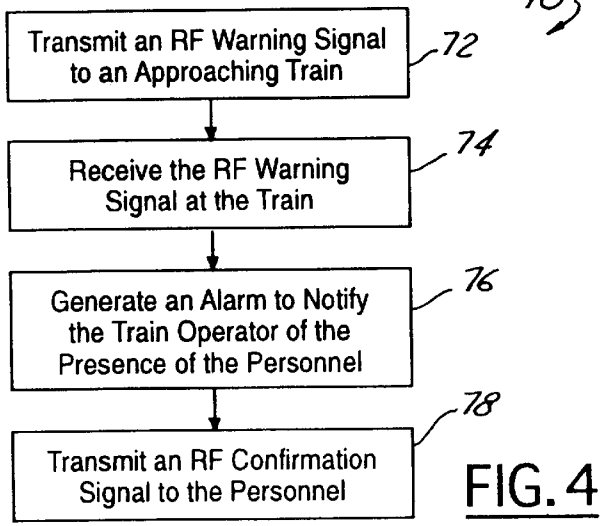
FIG. 4 is a flow diagram representing operation of the warning system and method.

Referring now to FIG. 4, a flow diagram 70 representing operation of the warning system and method of the present invention is shown. In general, flow diagram 70 warns a train operator that the train is approaching personnel working farther down the tracks. Flow diagram 70 begins with block 72 transmitting an RF warning signal at a given power output from a transmitter carried by at least one of the personnel to the train. The RF warning signal is transmitted continuously while the personnel are in the vicinity of the tracks. Block 74 then receives the RF warning signal with a receiver on the train. Block 76 then generates an alarm to notify the train operator of the presence of the personnel and that the train is approaching the personnel. Block 78 then transmits an RF confirmation signal from a transmitter on the train to a receiver carried by the at least one personnel. The RF confirmation signal indicates to the personnel that the train operator is aware of the presence of the personnel.

Thus, it is apparent that there has been provided, in accordance with the present invention, a train operator warning system and method that fully satisfies the objects, aims, and advantages set forth above.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. For instance, in addition to transmitting an RF warning signal, the transceivers disposed at the railroad station may transmit and receive other types of data such as personnel identification, train identification, train direction, tracks in use by the train, and the like.

What is claimed is:

1. A warning system for warning an operator of a train that the train is approaching personnel in proximity to railroad tracks, the system comprising:

a transmitter disposed adjacent the personnel in proximity to the railroad tracks for transmitting a radio frequency (RF) warning signal with a given power output along a wireless RF transmission path, wherein the given power output of the RF warning signal is dependent upon the speed of the train, wherein the RF warning signal is indicative of the presence of personnel in proximity to the railroad tracks;

a receiver disposed on the train for receiving the RF warning signal along the wireless RF transmission path, wherein the receiver disposed on the train receives the RF warning signal a predetermined amount of time prior to the train reaching the personnel, the predetermined amount of time being dependent upon the given power output of the RF warning signal, whereupon receiving the RF warning signal the receiver generates an alarm to notify the train operator of the presence of the personnel in proximity to the railroad tracks;

a transmitter disposed on the train for transmitting an RF confirmation signal upon receipt of the RF warning signal by the receiver disposed on the train; and a receiver disposed adjacent the personnel in proximity to the railroad tracks for receiving the RF confirmation signal, whereupon receiving the RF confirmation signal the receiver disposed adjacent the personnel in proximity to the railroad tracks generates an alarm to notify the personnel that the train operator is aware of the presence of the personnel in proximity to the railroad tracks.

2. The system of claim 1 wherein:

the transmitter disposed adjacent the personnel in proximity to the railroad tracks is a portable transmitter carried by at least one of the personnel.

3. The system of claim 1 wherein:

the receiver disposed adjacent the personnel in proximity to the railroad tracks is a portable receiver carried by at least one of the personnel.

4. The system of claim 1 wherein:

the alarm generated by the receiver disposed on the train is a visual alarm.

5. The system of claim 1 wherein:

the alarm generated by the receiver disposed on the train is an audio alarm.

6. The system of claim 1 wherein:

the alarm generated by the receiver disposed on the train is a vibratory alarm.

7. A warning system for warning an operator of a train that the train is approaching personnel in proximity to railroad tracks, the system comprising:

a portable transmitter carried by at least one of the personnel for transmitting a radio frequency (RF) warning signal at a given power output along a wireless RF transmission path, wherein the given power output of the RF warning signal is dependent upon the speed of the train, wherein the RF warning signal is indicative of the presence of the personnel in proximity to the railroad tracks;

a receiver disposed on the train for receiving the RF warning signal along the wireless RF transmission path, wherein the receiver disposed on the train receives the RF warning signal a predetermined amount of time prior to the train reaching the personnel, the predetermined amount of time being dependent upon the given power output of the RF warning signal, whereupon receiving the RF warning signal the receiver generates an alarm to notify the train operator of the presence of the personnel in proximity to the railroad tracks;

a transmitter disposed on the train for transmitting an RF confirmation signal upon receipt of the RF warning signal by the receiver disposed on the train; and a portable receiver carried by the at least one of the personnel for receiving the RF confirmation signal, whereupon receiving the RF confirmation signal the portable receiver generates an alarm to notify the at least one of the personnel that the train operator is aware of the presence of the personnel in proximity to the railroad station.

8. A method for warning a operator of a train that the train is approaching personnel in proximity to railroad tracks, the method comprising:

transmitting a radio frequency (RF) warning signal at a given power output along a wireless RF transmission path from the personnel in proximity to the railroad tracks, wherein the given power output of the RF warning signal is dependent upon the speed of the train, wherein the RF warning signal is indicative of the presence of the personnel in proximity to the railroad tracks; and receiving the RF warning signal along the wireless RF transmission path with a receiver disposed on the train, wherein the receiver disposed on the train receives the RF warning signal a predetermined amount of time prior to the train reaching the personnel, the predetermined amount of time being dependent upon the given power output of the RF warning signal;

generating an alarm to notify the train operator of the presence of the personnel in proximity to the railroad tracks upon receipt of the RF warning signal by the receiver disposed on the train;

transmitting an RF confirmation signal from the train upon receipt of the RF warning signal by the receiver disposed on the train;

receiving the RF confirmation signal by the personnel in proximity to the railroad tracks; and generating an alarm to notify the personnel that the train operator is aware of the presence of the personnel in proximity to the railroad tracks upon receipt of the RF confirmation signal by the personnel in proximity to the railroad tracks.

9. The method of claim 8 wherein:

transmitting an RF warning signal comprises transmitting an RF warning signal with a portable transmitter carried by at least one of the personnel.

10. The method of claim 8 wherein:

receiving the RF confirmation signal comprises receiving the RF confirmation signal with a portable receiver carried by at least one of the personnel.

* * * * *